US012152208B2

(12) United States Patent
Zhang

(10) Patent No.: US 12,152,208 B2
(45) Date of Patent: Nov. 26, 2024

(54) SOLID ADDITION-TYPE DIESEL ENVIRONMENTAL PROTECTION ANTI-SMOKE ADDITIVE AND METHOD FOR PREPARING THE SAME

(71) Applicant: Ruixue Zhang, Wuhan (CN)

(72) Inventor: Ruixue Zhang, Wuhan (CN)

( * ) Notice: Subject to any disclaimer, the term of this patent is extended or adjusted under 35 U.S.C. 154(b) by 0 days.

(21) Appl. No.: 18/119,509

(22) Filed: Mar. 9, 2023

(65) Prior Publication Data

US 2024/0301310 A1 Sep. 12, 2024

(51) Int. Cl.

| | |
|---|---|
| ***C10L 1/14*** | (2006.01) |
| ***C10L 1/16*** | (2006.01) |
| ***C10L 1/19*** | (2006.01) |
| ***C10L 1/226*** | (2006.01) |
| ***C10L 1/30*** | (2006.01) |
| ***C10L 10/02*** | (2006.01) |

(52) U.S. Cl.

CPC ..... *C10L 1/14* (2013.01); *C10L 10/02* (2013.01); *C10L 1/1608* (2013.01); *C10L 1/19* (2013.01); *C10L 1/226* (2013.01); *C10L 1/305* (2013.01); *C10L 2200/0446* (2013.01); *C10L 2270/026* (2013.01)

(58) Field of Classification Search

CPC .... C10L 1/14; C10L 1/19; C10L 1/226; C10L 1/305; C10L 1/1608; C10L 10/02; C10L 2200/0446; C10L 2270/026

See application file for complete search history.

(56) References Cited

U.S. PATENT DOCUMENTS

| | | | | |
|---|---|---|---|---|
| 6,638,325 | B1 * | 10/2003 | Brod | C10M 161/00 44/393 |
| 2003/0154646 | A1 * | 8/2003 | Hazarika | C10L 10/04 44/321 |
| 2010/0151396 | A1 * | 6/2010 | Papachristos | C10L 1/1857 44/361 |

* cited by examiner

*Primary Examiner* — James C Goloboy

(74) *Attorney, Agent, or Firm* — Kunzler Bean & Adamson; Michael Bartholomew

(57) ABSTRACT

The present invention provides a solid addition-type diesel environmental protection anti-smoke additive and a method for preparing the same. The additive includes a solvent, vinyl ferrocene, and vinyl acetate. The method includes the following steps: under the condition that nitrogen is introduced to completely replace air, adding to a high-pressure reactor the solvent, vinyl ferrocene, vinyl acetate, and a free radical initiator; starting stirring to introduce a high-pressure vinyl monomer; polymerizing and synthesizing a free radical into a crude product of a diesel anti-smoke oxidant; under the condition of the constant temperature of a system, completing reaction when a pressure is not changed for 60 min; cooling down a reaction product to a room temperature and releasing the pressure to an atmospheric pressure to obtain the crude product; and performing atmospheric distillation for the crude product to remove a petroleum ether and an unreacted raw material from the crude product.

6 Claims, No Drawings

SOLID ADDITION-TYPE DIESEL ENVIRONMENTAL PROTECTION ANTI-SMOKE ADDITIVE AND METHOD FOR PREPARING THE SAME

TECHNICAL FIELD

The present invention relates to the technical field of functional diesel additives, and specifically to a solid addition-type diesel environmental protection anti-smoke additive and a method for preparing the same.

TECHNICAL BACKGROUND

Diesel is a light petroleum product blended by a diesel fraction produced by crude oil distillation, catalytic cracking, thermal cracking, hydrocracking, petroleum coking and other processes, belongs to a complex hydrocarbon mixture, and generally has a molecular carbon chain length of 15-24. Due to a relatively long carbon chain of a diesel molecule, the diesel can provide more energy in a combustion process transferred into power output. Therefore, the diesel is widely used as a fuel of a heavy vehicle (a heavy transport vehicle and a large passenger vehicle). Although the diesel as a power fuel has the characteristics of high thermal efficiency and good economy, due to the characteristics of the diesel and the poor working conditions in a use occasion, the diesel is easy to have insufficient combustion during combustion, resulting in a black smoke, which causes air pollution.

With the rapid development of the economy and society, and the improvement of people's living standards, the installation base of diesel motor vehicles is getting higher and higher. Therefore, the large consumption of the diesel and the exhaust emission pollution from a diesel engine have increased greatly. Although there is a trend of an electric vehicle to replace a diesel vehicle in recent years, due to the characteristics of the diesel engine and the special nature of a use occasion, it is difficult to replace all diesel vehicles with the electric vehicles in a short term. Therefore, it is especially important to improve the full combustion of the diesel in the diesel engine and reduce the emission of the black smoke.

At present, there are many diesel oxidizing anti-smoke additives on the market to improve the combustion efficiency (reduce consumption) of the diesel and reduce the black smoke in an exhaust of the diesel engine. Due to the special efficacy of ferrocene in eliminating smoke and oxidizing, the main anti-smoke and oxidizing component of this product is mainly a ferrocene compound. Meanwhile, this product is a liquid product. The production and processing of the liquid product requires relatively complicated equipment and preparation processes and has special requirements for a production environment, product transportation, and a packaging material. In addition, a ferrocene powder is directly manufactured into particles added to the diesel, which has the problem of a slow dissolution speed. With the combination of these factors, the ferrocene anti-smoke oxidant in diesel is very limited in actual use.

SUMMARY

An embodiment of the present invention provides a solid addition-type diesel environmental protection anti-smoke additive and a method for preparing the same. The solid addition-type diesel environmental protection anti-smoke additive prepared by the method is used in diesel, which effectively improves the combustion efficiency of the diesel and reduces diesel consumption while reducing the emission of a black smoke and other pollutants in an exhaust of a diesel engine. The diesel anti-smoke oxidant also has a fast dissolution speed in the diesel, simple production of a raw material, convenient packaging, storage, and transportation, simple addition of the additive, price advantage and other characteristics.

In view of the above problems, the technical solution proposed by the present invention is as follows:

A solid addition-type diesel environmental protection anti-smoke additive includes the following components:

a solvent, vinyl ferrocene, vinyl acetate, a free radical initiator, ethylene, a high-pressure vinyl monomer, tetramethylbenzene.

The present invention also provides a method for preparing a solid addition-type diesel environmental protection anti-smoke additive, comprising the steps of:

under a condition that nitrogen is introduced to completely replace air, adding to a high-pressure reactor 10-15 parts of a solvent, 2-5 parts of vinyl ferrocene, 20-40 parts of vinyl acetate, and 1-3 parts of a free radical initiator; starting stirring to introduce a high-pressure vinyl monomer; polymerizing a free radical; controlling a reaction temperature of a system to a temperature of 60-90° C. by controlling jacket cooling water or high-temperature constant-temperature water; controlling injection of ethylene to maintain a pressure of the system at 4-7 MPa; under a condition of a constant temperature of the system, completing a reaction when the pressure does not change for 60 min; and cooling down a reaction product to a room temperature and releasing the pressure to an atmospheric pressure to obtain a crude product;

performing atmospheric distillation for the crude product at a temperature of 90-150° C. to remove a petroleum ether and an unreacted raw material to obtain a white to light yellow solid paste diesel anti-smoke oxidant at the room temperature; mixing the solid diesel anti-smoke oxidant obtained by the reaction with homotetramethylbenzene; performing extrusion moulding for a mixture at a temperature of 50-70° C.; and then cutting the mixture into a flake agent with a suitable size as required, to obtain the solid addition-type diesel environmental protection anti-smoke additive.

As a preferred technical solution of the present invention, the vinyl ferrocene, the vinyl acetate, and the ethylene in the diesel anti-smoke oxidant have a mass ratio of 2-5%:20-40%:50-75%.

As a preferred technical solution of the present invention, the solvent is the petroleum ether (90-120° C.) or toluene.

As a preferred technical solution of the present invention, the solvent and a polymeric monomer has a weight ratio of 4:6-6:4.

As a preferred technical solution of the present invention, the free radical initiator is azo diisobutyronitrile or azo diisobutyric acid dimethyl ester.

As a preferred technical solution of the present invention, the free radical initiator accounts for 1-3% of total consumption of a material.

As a preferred technical solution of the present invention, the diesel anti-smoke oxidant and homotetramethylbenzene have a weight ratio of 2:1-1:6.

Compared with the prior art, the beneficial effects of the present invention are as follows: the vinyl ferrocene, the vinyl acetate, and the ethyleneare polymerized in the solvent and the free radical initiator under the action of initiation of a free radical to obtain a crude product of the diesel anti-smoke oxidant. The solvent is recovered from the crude product of the diesel anti-smoke oxidant through atmospheric distillation to obtain a solid paste diesel anti-smoke oxidant. The solid paste diesel anti-smoke oxidant is mixed with the homotetramethylbenzene. A mixture is performed with extrusion molding and sliced to finally obtain the solid addition-type diesel environmental protection anti-smoke additive. The solid-type diesel anti-smoke oxidant is added to diesel in proportion, which not only does not affect the indicators of the diesel, but also can effectively reduce the emission of hydrocarbon, CO and black smoke particles after the solid-type diesel anti-smoke oxidant is added to the diesel, while achieving the effects of oxidizing and diesel saving.

The foregoing descriptions are only brief descriptions of the technical solutions in the present invention. To understand the technical means in the present invention more clearly so that the technical means may be carried out according to the content of the specification, and to make the foregoing and other objectives, features and advantages of the present invention more apparent and understandable, specific implementations of the present invention are illustrated particularly below.

DETAILED DESCRIPTION OF EMBODIMENTS

To make the above-mentioned features and advantages of the present invention more obvious and understandable, specific embodiments of the present invention are described in details. Many specific details are set forth in the following description to fully understand the present invention.

A solid addition-type diesel environmental protection anti-smoke additive includes the following components:

a solvent, vinyl ferrocene, vinyl acetate, a free radical initiator, ethylene, a high-pressure vinyl monomer, tetramethylbenzene.

The present invention also provides a method for preparing a solid addition-type diesel environmental protection anti-smoke additive, comprising the steps of:

Step 1: under the condition that nitrogen was introduced to completely replace air, adding to a high pressure reactor a solvent, vinyl ferrocene, vinyl acetate, and a free radical initiator, starting stirring to introduce a high-pressure vinyl monomer, and polymerizing and synthesizing a free radical into a crude product of a diesel anti-smoke oxidant.

As an embodiment of the present invention, further, the vinyl ferrocene, the vinyl acetate, and the ethylene of reaction monomers had a mass ratio of 5%:20-40%:50-75%.

As an embodiment of the present invention, further, the solvent was a petroleum ether or toluene.

As an embodiment of the present invention, further, the solvent and the polymeric monomer had a weight ratio of 4:6-6:4.

As an embodiment of the present invention, further, the free radical initiator was azo diisobutyronitrile or azo diisobutyric acid dimethyl ester.

As an embodiment of the present invention, furthermore, the free radical initiator accounted for 1-3% of total consumption of a material.

As an embodiment of the present invention, further, the injection of ethylene was controlled to maintain the pressure of the system of 4-7 MPa.

As an embodiment of the present invention, further, a polymerization temperature was controlled by controlling jacket cooling water, and ranges from 60° C. to 90° C.

Step 2: under the condition of the constant temperature of a system, completing a reaction when a pressure was not changed for 60 min; cooling down a reaction product to a room temperature and releasing the pressure to an atmospheric pressure to obtain the crude product; and performing atmospheric distillation for the crude product to remove the petroleum ether and an unreacted raw material from the crude product to obtain a white to light yellow solid paste diesel anti-smoke oxidant at the room temperature.

As an embodiment of the present invention, further, a constant-temperature condition was at a temperature of 60-90° C.

As an embodiment of the invention, further, the crude product was performed with atmospheric distillation at a temperature of 90-150° C. to remove the petroleum ether.

Step 3: mixing the diesel anti-smoke oxidant obtained after the solvent was removed by atmospheric distillation with homotetramethylbenzene, performing extrusion moulding for a mixture and then cutting the mixture into a flake agent with a suitable size according to sales requirements, to obtain the solid addition-type diesel environmental protection anti-smoke additive.

As an embodiment of the present invention, further, the diesel anti-smoke oxidant and the homotetramethylbenzene had a weight ratio of 2:1-1:6.

As an embodiment of the present invention, further, the diesel anti-smoke oxidant was mixed with the homotetramethylbenzene. The mixture was extruded and moulded at a temperature of 50-70° C. An extruded product was rapidly cooled down to a temperature of 20-30° C.

The method for preparing the solid addition-type diesel environmental protection anti-smoke additive includes the following steps of: first, polymerizing the free radical with the vinyl ferrocene, the vinyl acetate, the ethylene in the presence of the free radical initiator and the solvent; cooling down the polymerized crude product of the diesel anti-smoke oxidant; removing the solvent through the atmospheric distillation; finally, mixing the diesel anti-smoke oxidant after the solvent is removed and the homotetramethylbenzene; heating, extruding, moulding and slicing the mixture to obtain the solid addition-type diesel environmental protection anti-smoke additive; polymerizing ferrocene into an oil-soluble polymer with a low molecular weight, and hence effectively increasing a dissolution speed of ferrocene in diesel, while obtaining a polymer with a lower melting point, which is convenient for extrusion moulding by low-temperature heating; and mixing the diesel anti-smoke oxidant with the homotetramethylbenzene and heating at a low temperature, extruding and moulding the mixture. An obtained product was better than a liquid product conventionally made of ferrocene and a product directly tabletted by a ferrocene powder, and has the advantages of a fast dissolution speed in diesel, simple equipment required for production and processing, a relatively simple preparation process, no special requirements for production environment, product transportation, and a packaging material, etc.

Embodiment 1

5 kg of solid vinyl ferrocene and 1 kg of a solid azo diisobutyronitrile initiator were put into a reaction kettle. Nitrogen was continuously introduced into the reaction kettle to replace air for 60 min. After the replacement of the nitrogen was completed, 50 kg of a petroleum ether (at a temperature of 90-120° C.) and 30 kg of vinyl acetate were pumped into the reaction kettle. A feeding hole and a discharge hole/a ventilation port of the reaction kettle were closed. Stirring started for 10 min until a mixture was homogeneous. After stirring time reached, high-pressure ethylene was slowly introduced, and a pressure of the reaction kettle was raised to 4 MPa. After the pressure of the reaction kettle reached, a temperature started to slowly be increased from a room temperature to 60° C. When the temperature of a material reached 60° C., the polymerization speed of a free radical was significantly accelerated, and a temperature of reaction exotherm was obviously increased. At this time, the temperature was controlled by jacket cooling water in the reaction kettle to maintain the temperature of the material no more than 75° C. As a reaction proceeded, with the consumption of the ethylene, the pressure dropped. The pressure of a system was maintained by controlling the injection of the ethylene. When the reaction reached a later stage, the temperature of the system dropped. At this time, water at a constant temperature of 70° C. was introduced to heat the material to keep the temperature of the material constant at a temperature of 60° C. When the temperature of the material was constant, if the ethylene is not supplemented, the pressure of the system remained unchanged for 30 min, and the reaction could be considered to reach an end point. The ethylene stopped being heated. The material was cooled down by the cooling water to a room temperature. After the pressure was released to an atmospheric pressure, the solvent was removed from the material by 145° C. atmospheric distillation. The obtained diesel anti-smoke oxidant was mixed with homotetramethylbenzene, and a mixture was extruded, moulded and sliced at a temperature of 70° C., to obtain the solid addition-type diesel environmental protection anti-smoke additive.

Embodiment 2

3 kg of solid vinyl ferrocene and 1.5 kg of a solid azo diisobutyronitrile initiator were put into a reaction kettle. Nitrogen was continuously introduced into the reaction kettle to replace air for 60 minutes. After the replacement of the nitrogen was completed, 50 kg of a petroleum ether (at a temperature of 90-120° C.) and 25 kg of vinyl acetate were pumped into the reaction kettle. A feeding hole and a discharge hole/a ventilation port of the reaction kettle were closed. Stirring started for 10 min until a mixture was homogeneous. After stirring time reached, high-pressure ethylene was slowly introduced, and a pressure of the reaction kettle was raised to 5 MPa. After the pressure of the reaction kettle reached, a temperature started to slowly be increased from a room temperature to 70° C. When the temperature of a material reached 70° C., the polymerization speed of a free radical was significantly accelerated, and a temperature of reaction exotherm was obviously increased. At this time, the temperature was controlled by jacket cooling water in the reaction kettle to maintain the temperature of the material no more than 90° C. As a reaction proceeded, with the consumption of the ethylene, the pressure dropped. The pressure of a system was maintained by controlling the injection of the ethylene. When the reaction reached a later stage, the temperature of the system dropped. At this time, water at a constant temperature of 75° C. was introduced to heat the material to keep the temperature of the material constant at a temperature of 70° C. When the temperature of the material was constant, if the ethylene is not supplemented, the pressure of the system remained unchanged for 30 min, and the reaction could be considered to reach an end point. The ethylene stopped being heated. The material was cooled down by the cooling water to a room temperature. After the pressure was released to an atmospheric pressure, the solvent was removed from the material by 140° C. atmospheric distillation. The obtained diesel anti-smoke oxidant was mixed with homotetramethylbenzene, and a mixture was extruded, moulded and sliced at a temperature of 55° C., to obtain the solid addition-type diesel environmental protection anti-smoke additive.

Embodiment 3

3 kg of solid vinyl ferrocene and 2 kg of a solid azo diisobutyric acid dimethyl ester initiator were put into a reaction kettle. Nitrogen was continuously introduced into the reaction kettle to replace air for 60 minutes. After the replacement of the nitrogen was completed, 50 kg of normal hexane and 35 kg of vinyl acetate were pumped into the reaction kettle. A feeding hole and a discharge hole/a ventilation port of the reaction kettle were closed. Stirring started for 10 min until a mixture was homogeneous. After stirring time reached, high-pressure ethylene was slowly introduced, and a pressure of the reaction kettle was raised to 4.5 MPa. After the pressure of the reaction kettle reached, a temperature started to slowly be increased from a room temperature to 65° C. When the temperature of a material reached 65° C., the polymerization speed of a free radical was significantly accelerated, and a temperature of reaction exotherm was obviously increased. At this time, the temperature was controlled by jacket cooling water in the reaction kettle to maintain the temperature of the material no more than 90° C. As a reaction proceeded, with the consumption of the ethylene, the pressure dropped. The pressure of a system was maintained by controlling the injection of the ethylene. When the reaction reached a later stage, the temperature of the system dropped. At this time, water at a constant temperature of 70° C. was introduced to heat the material to keep the temperature of the material constant at a temperature of 65° C. When the temperature of the material was constant, if the ethylene is not supplemented, the pressure of the system remained unchanged for 30 min, and the reaction could be considered to reach an end point. The ethylene stopped being heated. The material was cooled down by the cooling water to a room temperature. After the pressure was released to an atmospheric pressure, the solvent was removed from the material by 100° C. atmospheric distillation. The obtained diesel anti-smoke oxidant was mixed with homotetramethylbenzene, and a mixture was extruded, moulded and sliced at a temperature of 65° C., to obtain the solid addition-type diesel environmental protection anti-smoke additive.

Embodiment 4

4 kg of solid vinyl ferrocene and 2 kg of a solid azo diisobutyric acid dimethyl ester initiator were put into a reaction kettle. Nitrogen was continuously introduced into the reaction kettle to replace air for 60 minutes. After the replacement of the nitrogen was completed, 50 kg of a petroleum ether (at a temperature of 90-120° C.) and 27 kg of vinyl acetate were pumped into the reaction kettle. A feeding hole and a discharge hole/a ventilation port of the reaction kettle were closed. Stirring started for 10 min until a mixture was homogeneous. After stirring time reached, high-pressure ethylene was slowly introduced, and a pressure of the reaction kettle was raised to 4.5 MPa. After the pressure of the reaction kettle reached, a temperature started to slowly be increased from a room temperature to 68° C.

When the temperature of a material reached 68° C., the polymerization speed of a free radical was significantly accelerated, and a temperature of reaction exotherm was obviously increased. At this time, the temperature was controlled by jacket cooling water in the reaction kettle to maintain the temperature of the material no more than 90° C. As a reaction proceeded, with the consumption of the ethylene, the pressure dropped. The pressure of a system was maintained by controlling the injection of the ethylene. When the reaction reached a later stage, the temperature of the system dropped. At this time, water at a constant temperature of 75° C. was introduced to heat the material to keep the temperature of the material constant at a temperature of 68° C. When the temperature of the material was constant, if the ethylene is not supplemented, the pressure of the system remained unchanged for 30 min, and the reaction could be considered to reach an end point. The ethylene stopped being heated. The material was cooled down by the cooling water to a room temperature. After the pressure was released to an atmospheric pressure, the solvent was removed from the material by 130° C. atmospheric distillation. The obtained diesel anti-smoke oxidant was mixed with homotetramethylbenzene, and a mixture was extruded, moulded and sliced at a temperature of 60° C., to obtain the solid addition-type diesel environmental protection anti-smoke additive.

TABLE 1

Indicators of a solid addition-type diesel anti-smoke oxidant prepared in Embodiments 1-4 after adding to 0# diesel.

| Serial number | Test items | Test method/test basis | Quality indicators | Test results | Test results | Test results | Test results | Conclusion of individual item |
|---|---|---|---|---|---|---|---|---|
| 1 | Oxidation stability (counted in terms of total insoluble substance), mg/100 ml | SH/T 0175-2004 | ≤2.5 | 0.4 | 0.42 | 0.37 | 0.45 | Qualified |
| 2 | Sulfur content, mg/kg | SH/T 0689-2004 | ≤10 | 3.8 | 3.6 | 3.9 | 4.0 | Qualified |
| 3 | Acidity (by KOU), mg/100 ml | GB/T 258-2016 | ≤7 | 3.94 | 3.99 | 3.84 | 3.97 | Qualified |
| 4 | 10% residual carbon for evaporation, % (mass fraction) | GB/T 17144-1997 | ≤0.3 | 0.03 | 0.03 | 0.03 | 0.03 | Qualified |
| 5 | Ash, % (mass fraction) | GB/T 508-1985 | ≤0.01 | 0.001 | 0.001 | 0.001 | 0.001 | Qualified |
| 6 | Copper corrosion (50° C., 3 h), level | GB/T 5096-2017 | ≤1 | 1a | 1a | 1a | 1a | Qualified |
| 7 | Water content, % (volume fraction) | GB/T 260-2016 | VI Traces | None | None | None | None | Qualified |
| 8 | Lubricity (corrected abrasion diameter (60° C.), microns) | SH/T 0765-2005 | ≤460 | 381 | 405 | 365 | 397 | Qualified |
| 9 | Polycyclic aromatic hydrocarbon content, % (mass fraction) | NB/GB/T 0606-2019 | ≤7 | 2.7 | 2.8 | 2.6 | 2.9 | Qualified |
| 10 | Total pollutant content, mg/kg | GB/T 33400-2016 | ≤24 | 3.5 | 4.1 | 4.2 | 3.8 | Qualified |
| 11 | Kinematic viscosity (20° C.), $mm^2/s$ | GB/T 265-1988 | 3.0-8.0 | 4.266 | 4.266 | 4.266 | 4.266 | Qualified |
| 12 | Freezing point, ° C. | GB/T 510-2018 | ≤0 | 9.5 | 9.5 | 9.5 | 9.5 | Qualified |
| 13 | Cold filter plugging point, ° C. | NB/GB/T 0248-2019 | ≤4 | −6 | −6 | −6 | −6 | Qualified |
| 14 | Flashing point (closed), ° C. | GB/T 261-2008 | ≥60 | 71.0 | 71.0 | 71.0 | 71.0 | Qualified |
| 15 | Cetane value | GB/T 386-2010 | ≥51 | 60.1 | 60.1 | 60.1 | 60.1 | Qualified |
| 16 | Cetane indicator | SH/T 0694-2000(2007) | ≥46 | 55.6 | 55.6 | 55.6 | 55.6 | Qualified |
| 17 | Distillation range: 50% recovery temperature ° C. | GB/T 6536-2010 | ≤300 | 266.8 | 267.6 | 265.2 | 266.0 | Qualified |
| | 90% recovery temperature ° C. | | ≤355 | 323.2 | 323.4 | 322.8 | 324.0 | |
| | 95% recovery temperature ° C. | | ≤365 | 337.8 | 338.2 | 337.2 | 339.0 | Qualified |
| | | | | | | | | Qualified |
| 18 | Density (20° C.), $kg/m^3$ | SH/T 0604-2000 | 810-845 | 825.7 | 825.7 | 825.7 | 825.7 | Qualified |

TABLE 1-continued

Indicators of a solid addition-type diesel anti-smoke oxidant prepared in Embodiments 1-4 after adding to 0# diesel.

| Serial number | Test items | Test method/test basis | Quality indicators | Test results | Test results | Test results | Test results | Conclusion of individual item |
|---|---|---|---|---|---|---|---|---|
| 19 | Fatty acid methyl ester content, % (volume fraction) | NG/SH/T 0616-2015 | ≤1.0 | <0.1 | <0.1 | <0.1 | <0.1 | Qualified |

TABLE 2

A diesel saving rate (i.e. a smoke intensity reduction rate) tested on a diesel engine bench (the same rotation speed: 2000 rpm) after a solid addition-type diesel anti-smoke oxidant in Embodiments 1-4 was added to 0# diesel at 2 g: 60 L (2 g of additive: 60 L of diesel).

| Rotation speed/ rpm | Engine load/ % | Diesel saving rate/% | | | | Smoke intensity reduction rate/% | | | |
|---|---|---|---|---|---|---|---|---|---|
| | | Embodiment 1 | Embodiment 2 | Embodiment 3 | Embodiment 4 | Embodiment 1 | Embodiment 2 | Embodiment 3 | Embodiment 4 |
| 1400 | 50 | 9.8 | 10.2 | 9.4 | 12.5 | 24 | 26.5 | 22 | 28 |
| 1400 | 100 | 8.6 | 9.3 | 7.9 | 10.2 | 20 | 21 | 18.5 | 23 |
| 2000 | 50 | 7.1 | 7.5 | 6.7 | 8.8 | 17.5 | 16 | 19 | 20 |
| 2000 | 100 | 6.8 | 6.9 | 5.8 | 7.9 | 22 | 23 | 20.5 | 22 |

The solid addition-type diesel oxidizing additive of the present invention greatly increased the solubility of ferrocene in the diesel by combining the ferrocene with the polymer. A paste solid form of the additive was especially suitable for an extrusion moulding process after the additive was mixed with homotetramethylbenzene. The extrusion moulding had simple and safe process steps. The requirements for equipment are low. The solid tablet diesel oxidizing anti-smoke additive was easier to store and transport than liquid one. The amount of addition of the additive in diesel fuel was small, which did not affect the physical and chemical indicators of the diesel while being able to improve the combustion of the engine, and reduce the diesel consumption and the emission of a black smoke and pollutants.

Obviously, a person skilled in the art can make various modifications and variations to the present invention without departing from the spirit and scope of the present invention. Thus, if these modifications and variations of the present invention are within the scope of the claims of the present invention and their technical equivalents, the present invention is also intended to encompass these modifications and variations.

What is claimed is:

1. A method for preparing a solid addition-type diesel environmental protection anti-smoke additive, the method comprising:

under a nitrogen atmosphere, adding to a high-pressure reactor 10-15 parts by weight of a solvent, 2-5 parts by weight of vinyl ferrocene, 20-40 parts by weight of vinyl acetate, and 1-3 parts by weight of a free radical initiator, to produce a first mixture;

introducing a vinyl monomer to the first mixture while stirring;

polymerizing a free radical in the presence of the first mixture;

controlling a reaction temperature of a system to a temperature of 60-90° C. by controlling jacket cooling water or high-temperature constant-temperature water;

injecting ethylene to maintain a pressure of the system at 4-7 MPa;

under a condition of a constant temperature of the system, terminating a reaction when the pressure does not change for 60 min;

cooling down a reaction product to a room temperature and releasing the pressure to an atmospheric pressure to obtain a crude product;

performing atmospheric distillation for the crude product at a temperature of 90-150° C. to remove a petroleum ether and an unreacted raw material to obtain a white to yellow solid paste diesel anti-smoke oxidant at the room temperature;

mixing the solid diesel anti-smoke oxidant obtained by the reaction with homotetramethylbenzene to produce a second mixture;

performing extrusion molding for the mixture at a temperature of 50-70° C.; and cutting the second mixture into a flake agent, to obtain the solid addition-type diesel environmental protection anti-smoke additive.

2. The method of claim 1, wherein the vinyl ferrocene, the vinyl acetate, and the ethylene are present in the diesel anti-smoke oxidant in amounts by weight of 2-5%, 20-40%, and 50-75% respectively.

3. The method of claim 1, wherein the solvent is the petroleum ether (at a temperature of 90-120° C.) or toluene.

4. The method of claim 1, wherein the solvent and a polymeric monomer have a weight ratio of 4:6-6:4.

5. The method of claim 1, wherein the free radical initiator is azo diisobutyronitrile or azo diisobutyric acid dimethyl ester.

6. The method of claim 1, wherein the diesel anti-smoke oxidant and the homotetramethylbenzene have a weight ratio of: 2:1-1:6.

* * * * *